US005517984A

United States Patent [19]

Sanders

[11] Patent Number: 5,517,984

[45] Date of Patent: May 21, 1996

[54] MULTIPLE LAYER PRESSURIZED $O_2$ COIL PACKAGE

[75] Inventor: Stan A. Sanders, 420 29th St., Hermosa Beach, Calif. 90503

[73] Assignees: Stan A. Sanders; William F. Meistrell, Rancho Palos Verdes, Calif.; a part interest

[21] Appl. No.: 404,272

[22] Filed: Mar. 14, 1995

[51] Int. Cl.[6] ..... A62B 7/02

[52] U.S. Cl. ..... 128/205.22; 128/204.18; 128/200.24

[58] Field of Search ..... 128/200.24, 204.18, 128/205.22

[56] References Cited

U.S. PATENT DOCUMENTS

| | | | |
|---|---|---|---|
| 771,801 | 10/1904 | Andrew | 128/201.23 |
| 789,145 | 5/1905 | Derx | 128/202.19 |
| 2,380,372 | 7/1945 | Alderfer | 128/205.22 |
| 2,982,105 | 5/1961 | Akers | 128/205.22 |
| 3,491,752 | 1/1970 | Cowley | 128/201.22 |
| 3,837,337 | 9/1974 | LaViolette | 128/205.12 |
| 4,090,509 | 5/1976 | Smith | 128/202.19 |
| 4,253,454 | 3/1981 | Warncke | 128/202.26 |
| 4,932,403 | 6/1990 | Scholley | 128/205.22 |
| 4,964,405 | 10/1990 | Arnoth | 128/205.17 |
| 5,036,845 | 8/1991 | Scholley | 128/205.22 |
| 5,127,399 | 7/1992 | Scholley | 128/205.22 |

FOREIGN PATENT DOCUMENTS

| | | | |
|---|---|---|---|
| 4007274 | 12/1991 | Germany | 128/204.18 |

*Primary Examiner*—Edgar S. Burr
*Assistant Examiner*—William J. Deane, Jr.
*Attorney, Agent, or Firm*—William W. Haefliger

[57] ABSTRACT

In a back pack pressurized gas assembly, the combination comprising a structure including a back panel sized to be carried on the back of a human carrier; looping pipe coils carried by the structure in overlying relation to the back panel, and in closely coiled configuration in a plane parallel to the back panel whereby the coil means and back panel structure may be conformed closely to the human back; the looping coil means having pressurized gas outlet structure associated therewith, whereby the looping pipe coils may receive pressurized gas for transport and use by the human.

9 Claims, 2 Drawing Sheets

MULTIPLE LAYER PRESSURIZED $O_2$ COIL PACKAGE

BACKGROUND OF THE INVENTION

This invention relates generally to human transport of pressurized gas, and more particularly to a wearable structure incorporating pipe coil means that contains pressurized gas, such as oxygen, and wherein the pipe coil is generally conformable to the back of the wearer to which such gas is supplied.

There is need for improvements in apparatus to supply gas, such as oxygen, to a human patient needing such supply. Known apparatus comprises an oxygen tank, which is bulky and difficult to transport and wear, as for example strapped to the patient's back. Thus, there is need for oxygen supply apparatus which is conformable to the body of the wearer, and which is not bulky.

To my knowledge, no prior gas supply apparatus incorporated the unusually advantageous features of construction and operation, and produced the highly desirable results, as are now afforded by the present invention.

SUMMARY OF THE INVENTION

It is a major object of the invention to provide improved apparatus meeting the needs, as referred to above. Basically, a back pack pressurized gas assembly is provided and characterized by:

a) structure including a back panel sized to be carried on the back of a human carrier, b) looping pipe coil means carried by said structure in overlying relation to said back panel, and in closely coiled configuration in a plane parallel to the back panel, whereby the coil means and back panel structure may be conformed closely to the human back, c) the looping coil means having pressurized gas inlet and outlet fittings associated therewith, whereby the looping pipe coil means may receive pressurized gas for transport and use by the human.

Additional objects include the provision of attachment means connected with such structure for retaining the back panel and coil means to the back of the carrier; and protection padding extending at one side of the back panel for interposition between said back panel and pipe coil means, and the body of the human carrier.

As will be seen the structure typically forms a receptacle having upright, lateral and depth dimension, the depth dimension being substantially less than each of such upright and lateral dimensions.

Further, the pipe coil means is typically wound in a spiral that extends upright in adjacent relation to the back panel. Two or more such spirals each have inverted substantially delta configuration, to conform to the shape of the back of the wearer, whereby a minimum sized device is provided, as related to the shape of the human torso. A loose coat on the wearer can then cover the apparatus.

These and other objects and advantages of the invention, as well as the details of an illustrative embodiment, will be more fully understood from the following specification and drawings, in which:

DRAWING DESCRIPTION

DETAILED DESCRIPTION

Figure 1:
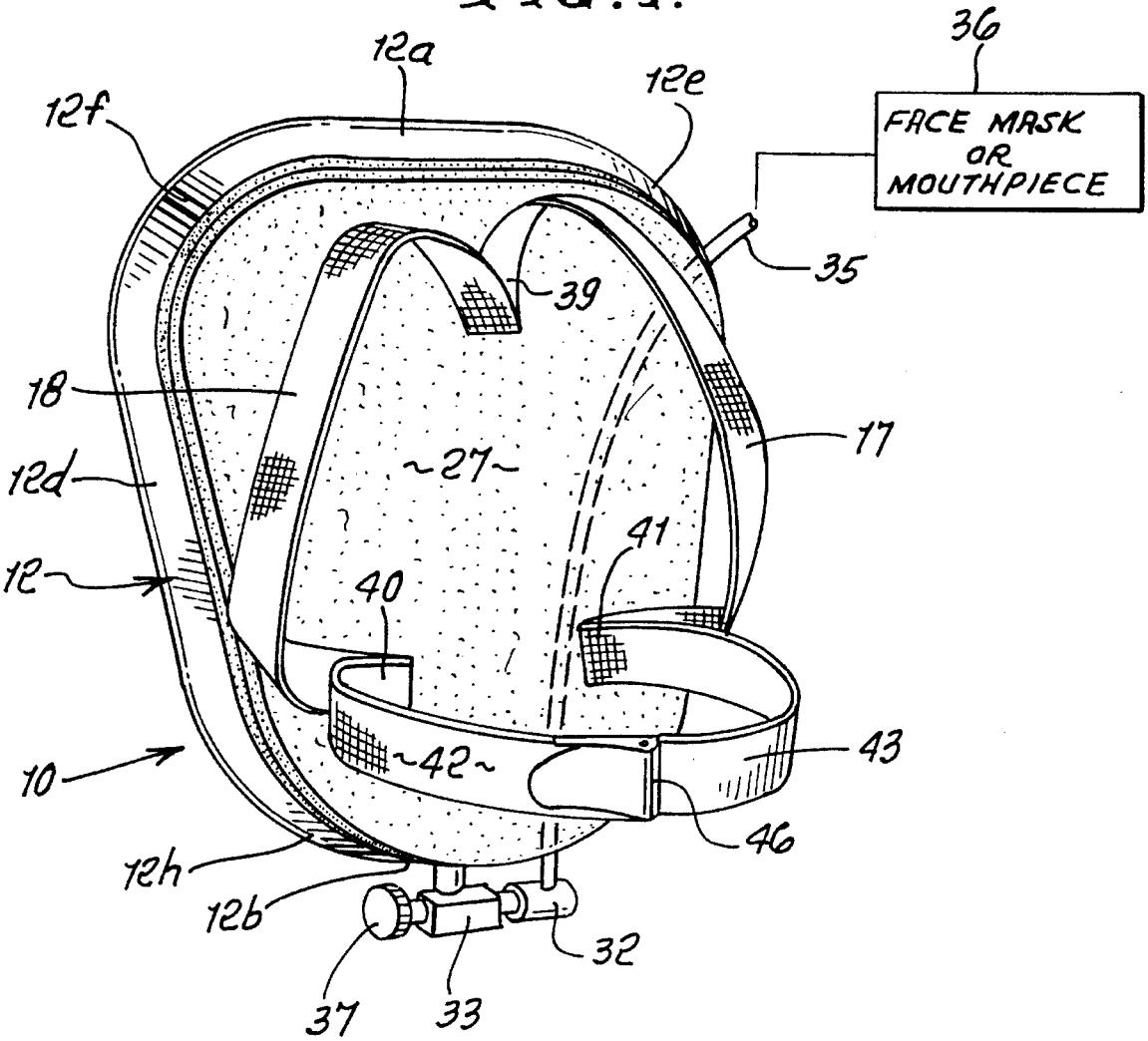
FIG. 1 is a perspective view of the front side of the apparatus of the invention.
Figure 4:
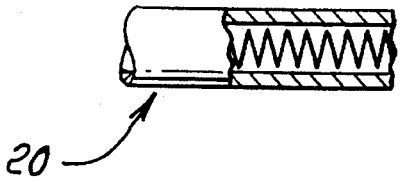
FIG. 4 is a fragmentary view of a spring controlled valve.
Figure 2:
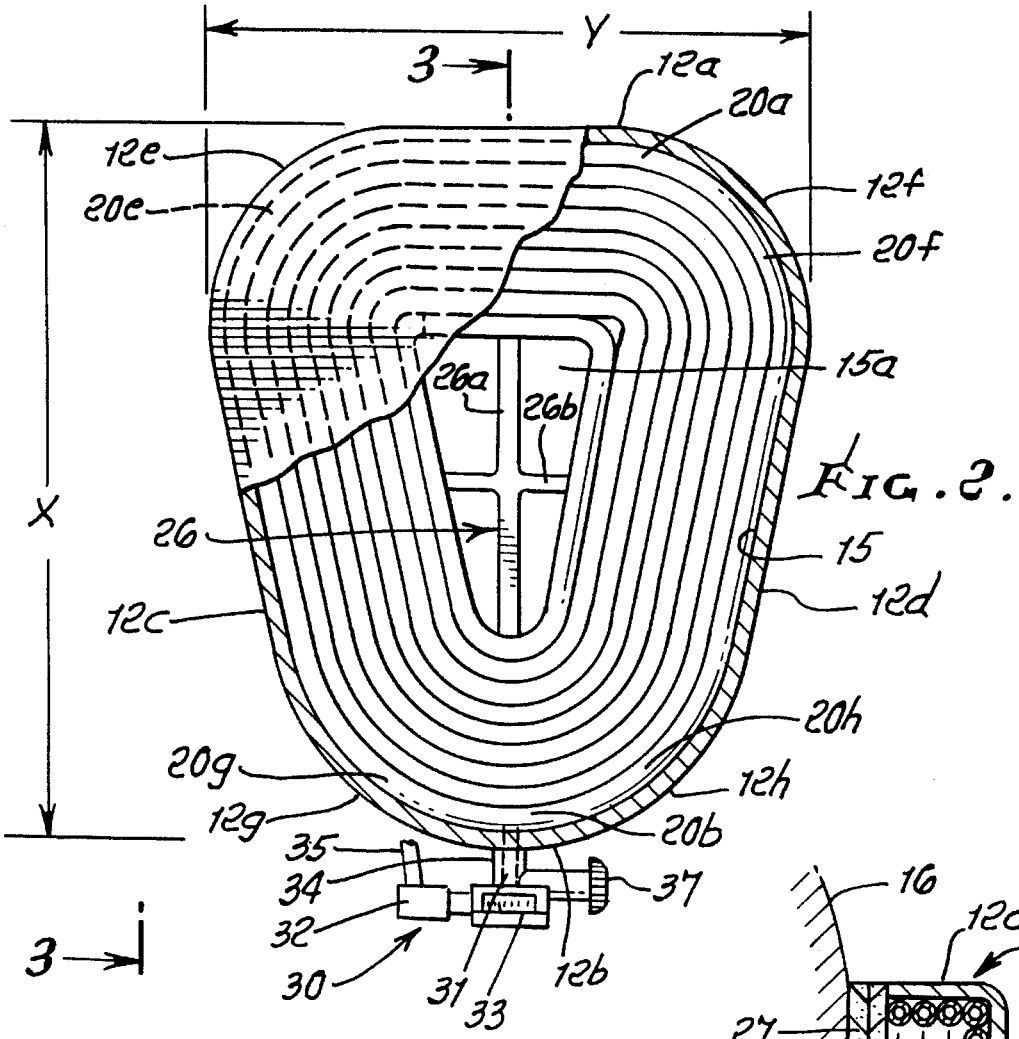
FIG. 2 is a rear view of the FIG. 1 apparatus, partly broken away to show interior construction.
Figure 3:
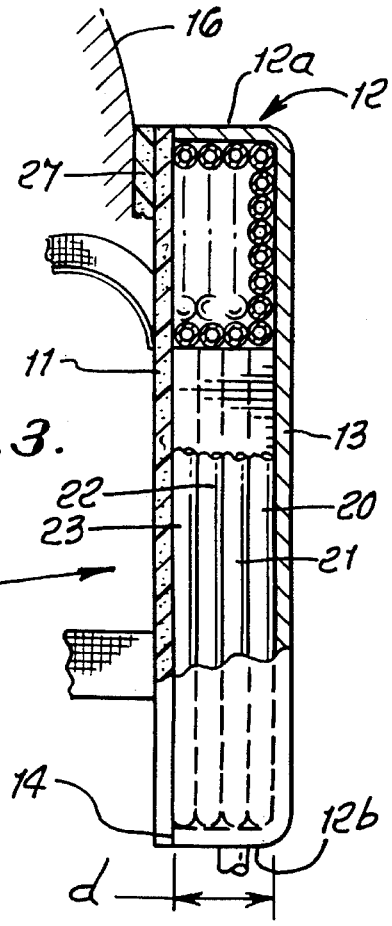
FIG. 3 is a section taken on lines 3—3 of FIG. 2.

In FIGS. 1–4, the structure 10 is shown in the form of a receptacle having a back panel 11 and a peripheral side wall 12 including uppermost and lowermost wall extents 12*a* and 12*h*, and left and right extents 12*c* and 12*d*. Wall extents 12*c* and 12*d* merge with the upper wall extent 12*a* at convexly curved corners 12*e* and 12*f*; and wall extents 12*c* and 12*d* merge with the lowermost wall extent 12*h* at convexly curved corners 12*g* and 12*h*. As shown in FIG. 2, the left and right, laterally separated wall extents 12*c* and 12*d* taper downwardly, as does the back panel 11, whereby the receptacle structure has modified inverted delta shape, as viewed from the rear, and also from the front in FIG. 1. Peripheral wall 12 may be integral with a cover panel 13, as best seen in FIG. 3, panel 13 being parallel to panel 11. Suitable connection of the integral cover panel and side wall 12 to panel 11 may be provided at 14, whereby an enclosure or receptacle is provided having an interior 15. The depth "d" of the enclosure is substantially less than the maximum vertical and lateral dimensions "x" and "y", as indicated, whereby when the apparatus is carried on the back 16 of a human user, it is much less prominent than a conventional oxygen bottle; also, it conforms generally to the tapering shape of the user's back, between shoulders and waist.

Attachment means is provided and connected with the receptacle for retaining the pack panel 11 to the back 16 of a human carrier or wearer. As shown, said attachment means may take the form of left and right looping straps 17 and 18 attached to the back panel as at upper and lower locations 19–21. Looping belt straps 122 and 123 may be connected to the back panel as at 20 and 21, and may be adjustably interconnected as by means of a buckle at 26. A thin protective and compressible pad, as for example of foam rubber, may be attached as a layer 27 on the back panel, to engage the wearer's back, for comfort.

In accordance with an important aspect of the invention, looping pipe coil means is or are carried by the structure 10 in overlying and adjacent relation to the back panel 11. The pipe coil means has closely coiled configuration in a plane or planes parallel to that of the back panel, for compactness, maximum coil length as within the interior 15, and close conformance of the assembly to the human back. The looping coil means has pressurized gas inlet and outlet fittings associated therewith, whereby the looping pipe coil means may receive pressurized gas for transport by the human.

In the example, several layers of like pipe coils are provided, as indicated at 20, 21, 22 and 23, in FIG. 3, the diameter of pipe of each coil being substantially less than the receptacle depth dimension "d". Thus, the coils 20–23 extend in parallel and stacked relation, to occupy substantially all of the interior 15, except for the relatively small central region 15*a* of that interior. Pipe coil mounting structure 26 is located in region 15*a*, and is attached to one of the panels 11 and 13, either of which can be regarded as a back panel.

The structure 26 is so formed as by struts 26*a* and 26*b* to mount the coils, wound about that structure, to form modified inverted delta coil shape substantially matching the shape of the side wall 12, whereby the successive loops in each coil extend sidewise adjacent one another, and the outermost loop in each coil conforms to the inner side of the delta shaped side wall. Thus, the coils are carried, in their overall dimensions, to conform well to the wearer's back shape, between broader shoulders, and slimmer waist. FIG. 2 shows tubing or coil 20 for example to have an outermost flight that includes:

uppermost and lowermost extents 20*a* and 20*b*, upper curved corner extents 20*e* and 20*f*, lower curved corner extents 20*g* and 20*h*.

Successive inward spiral flights of the coil 20 have corresponding extents, but of lesser length dimension. All of the coils 20–23 have the inverted delta shape characteristics, whereby packing of coils in the receptacle is optimized, or non-optimized.

FIG. 2 also shows fittings 30, to pass oxygen from connectors 31 to the spiral coils to outlet 32, all of which may be connected in series. A pressure level indicator appears at 33. Mounting struts appear at 34. Oxygen is supplied at 35 from the coils to a user's mouthpiece, indicated at 36, and via suitable control valving 37.

I claim:

1. In a back pack pressurized gas assembly, the combination comprising a) structure including a back panel sized to be carried on the back of a human carrier, b) looping pipe coil means carried by said structure in overlying relation to said back panel, and in closely coiled configuration parallel to the back panel, whereby said coil means and back panel structure may be conformed closely to the human back, c) said looping coil means having pressurized gas outlet means associated therewith, whereby the looping pipe coil means may receive pressurized gas for transport and use by the human, d) said pipe coil means being wound in at least two coil spirals that extend in two parallel upright planes in adjacent layered relation and proximate said back panel, e) each of said two spirals having left-to-right overall length less than upright overall length dimension, f) and including attachment means connected with said structure for retaining said back panel and coil means to the back of the carrier;

g) there being spacer structure about which said two coil spirals are closely wound, thereby to form the spirals to have downward peripheral taper throughout major upright length of the pipe coil means.

2. The combination of claim 1 wherein said structure forms a receptacle having upright, lateral and depth dimensions, said depth dimension being substantially less that each of said upright and lateral dimensions.

3. The combination of claim 1 wherein said back panel extends upright, and said pipe coil means is wound in a spiral that extends upright in adjacent relation to said back panel.

4. The combination of claim 1 wherein said at least two spirals each have inverted substantially delta configuration.

5. The combination of claim 4 wherein said two delta configurations have substantially the same overall size.

6. The combination of claim 1 wherein the attachment means has left and right arm openings, and said coil means extends between said arm openings.

7. The combination of claim 1 wherein said pipe coil means comprises first and second sub-coils extending in adjacent layered relation.

8. The combination of claim 1 including protection padding extending at one side of said back panel for interposition between said back panel and pipe coil means and the body of the human carrier.

9. The combination of claim 1 including pressurized $O_2$ in said coil means, and valving to control the flow of said $O_2$ to an outlet supplying reduced pressure $O_2$ to the mouth of the human carrier.

* * * * *